United States Patent [19]

Francois

[11] Patent Number: 4,946,048

[45] Date of Patent: Aug. 7, 1990

[54] ADJUSTABLE SHOE CAROUSEL

[76] Inventor: Edgard Francois, 974 St. Nicholas Ave., #6, New York, N.Y. 10032

[21] Appl. No.: 375,703

[22] Filed: Jul. 5, 1989

[51] Int. Cl.[5] ..... A47F 7/00

[52] U.S. Cl. ..... 211/34; 211/37; 211/131; 211/163; 211/207; 248/288.5

[58] Field of Search ..... 211/34, 37, 163, 166, 211/205, 207, 196, 131, 164; 248/288.5, 413, 415

[56] References Cited

U.S. PATENT DOCUMENTS

| | | | |
|---|---|---|---|
| 424,572 | 4/1890 | Painter | 248/288.5 X |
| 438,238 | 10/1890 | Jefferies et al. | 248/288.5 X |
| 2,082,088 | 6/1937 | Wilson . | |
| 2,152,692 | 4/1939 | Hereford | 211/166 X |
| 2,326,064 | 8/1943 | Pittman . | |
| 2,906,407 | 9/1959 | France . | |
| 3,059,948 | 10/1962 | Thompson et al. | 248/288.5 X |
| 3,135,389 | 6/1964 | Farley | 211/37 |
| 3,404,784 | 10/1968 | Scholfield | 211/164 |
| 4,756,429 | 7/1988 | Lehman et al. | 211/205 X |

*Primary Examiner*—Robert W. Gibson, Jr.
*Attorney, Agent, or Firm*—T. M. Gernstein

[57] ABSTRACT

A shoe holding carousel is adjustable in several planes and includes a telescoping support which as a ball joint therein. Shoe holding compartments are movably mounted on the carousel and thus the carousel is adjustable in both a vertical plane and in a horizontal plane.

4 Claims, 2 Drawing Sheets

ADJUSTABLE SHOE CAROUSEL

TECHNICAL FIELD OF THE INVENTION

The present invention relates to the general art of supports, and to the particular field of household clothing supports.

BACKGROUND OF THE INVENTION

Due to many factors, many people have found an extreme shortage of closest space. For this reason, there are many designs for closest extenders and the like. For example, people have gone to great expense to build extra shelves, extra clothing racks, extra drawers and the like into their closets in an effort to more efficiently use the room that is available to them.

One particular item that causes clutter in any closet, and especially in a crowded closet, is the storage of shoes. Shoes spread all over the closet floor can make an otherwise neat closet appear to be cluttered.

Thus, there have been several proposals for storing shoes, see, for example the devices disclosed in U.S. Pat. Nos. 2,082,088 and 2,326,064.

While such storage devices have been somewhat successful, they are still limited because they are not adjustable in a manner that will permit the storage device to be adapted to a new closet design should the closet be re-designed after installation of the shoe storage device. Thus, should a cluttered closet be "extended" and one of these devices used, and then should the owner desire to re-extend the closet, it is likely that the shoe storage device will have to be discarded as being obsolete.

Accordingly, there is a need for a shoe storage device that can accommodate a wide variety of closet designs.

OBJECTS OF THE INVENTION

It is a main object of the present invention to provide a shoe storage device that can accommodate a wide variety of closet designs.

It is another object of the present invention to provide a shoe storage device that can accommodate a wide variety of closet designs by being adjustable in a plurality of different planes.

It is another object of the present invention to provide a shoe storage device that can accommodate a wide variety of closet designs by being adjustable in a plurality of different planes including a vertical plane and a horizontal plane.

SUMMARY OF THE INVENTION

These, and other, objects are achieved by a shoe carousel that is adjustable in both the vertical plane and in the horizontal plane. The shoe carousel includes a support rod that is telescoping in nature, and a ball joint that permits the support rod to be bent as well as shoe supports that can be removed with respect to a mounting means.

In this manner, the shoe carousel can be adjusted to meet a wide variety of different space constraints. Thus, if the shoe carousel of the present invention is placed in a closet having one design, it can be easily adjusted if such closet design is varied.

BRIEF DESCRIPTION OF THE DRAWING FIGURES

DETAILED DESCRIPTION OF THE PREFERRED EMBODIMENT OF THE INVENTION

Figure 1:
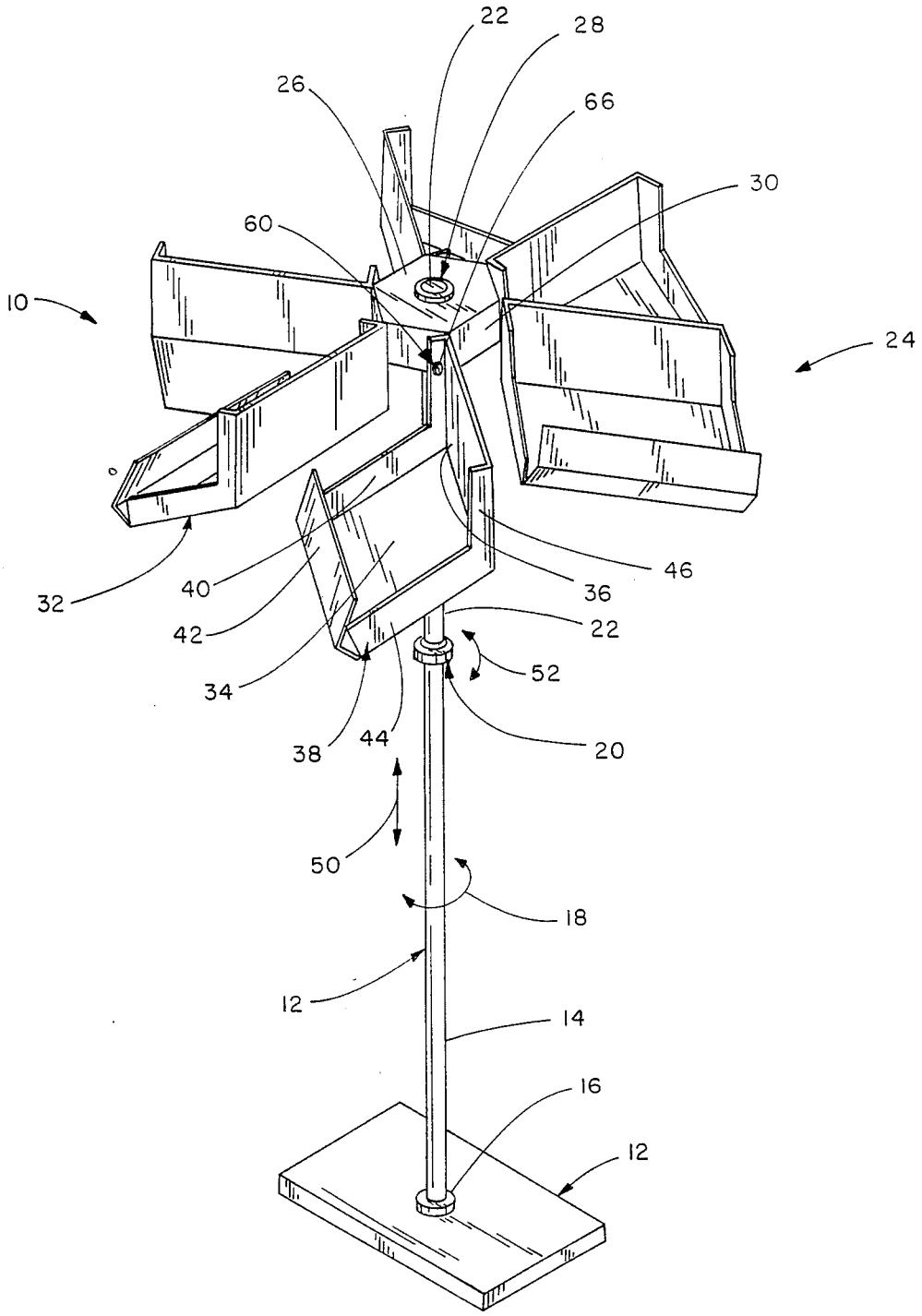
FIG. 1 is a perspective view of the shoe carousel embodying the present invention.

Shown in FIG. 1 is a shoe carousel 10 that is adjustable in a plurality of different planes, specifically in the horizontal plane and in the vertical plane, and embodying the present invention.

The shoe carousel 10 includes a base element 12 that supports the carousel on a floor or other such support surface, and a support unit 12 extending upwardly from the base element in the set up configuration shown in FIG. 1. The support unit 12 permits the carousel to be adjusted upwards away from the base element and downwards towards the base element in a vertical plane as well as permitting the carousel to be moved into various other configurations as will be seen from the ensuing discussion.

The support unit 12 includes a sleeve section 14 that is mounted at its bottom end in a step bearing 16 to be rotatable about its axis as indicated by double-headed arrow 18. The sleeve 14 extends upwardly from the base element 12 and includes a coupling joint 20 on its upper end. The joint 20 couples a rod 22 to the sleeve, with the rod being smaller than the sleeve to be telescopingly coupled to that sleeve. In this manner, the rod can be moved upwards away from the base element or downwards towards the base element to adjust the height of the carousel.

The rod 22 extends from the joint 20 upwards in the FIG. 1 condition and supports a shoe mounting unit 24 on an upper end thereof. The unit 24 includes a support element 26 rotatably mounted on the rod 22 by a sleeve bearing 28, with the support element being polygonal in shape to have a plurality of sides, such as side 30. The preferred shape of the element 26 is hexagonal, but other shapes can also be used without departing from the scope of the present invention.

A plurality of shoe mounting compartments, such as compartment 32, are attached to the support 26 at the sides of such support. Each compartment is adapted to support and store a pair of shoes therein, and includes a base section 34, a rear section 36 connected to the base section, side wall sections 38 and 40 also connected to the base section. A front section 42 is also connected to the base section at a location spaced from the rear section. The side sections each includes a first flange 44 located adjacent to the base section, and a second flange 46 located adjacent to the rear section.

The support 12 is adjustable to move in both a vertical plane and in a horizontal plane with the vertical plane movement being indicated in FIG. 1 by the double headed arrows 50 and 52, and with the horizontal plane movement being indicated by the double-headed arrow 18. The support moves in the horizontal plane as a result of the bearing 16, and in the vertical plane as a result of the joint 20.

Figure 2:
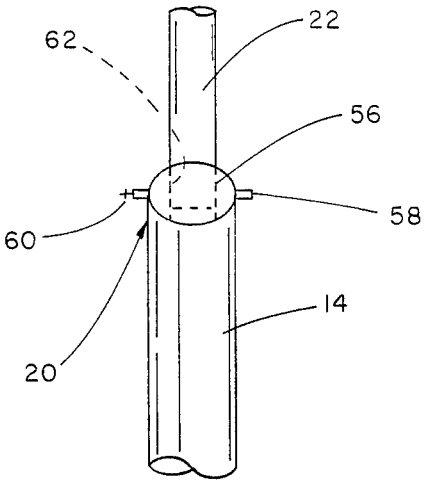
FIG. 2 is a schematic of a support joint in the configuration in which the support is fully extended in the upright configuration shown in FIG. 1.
Figure 3:
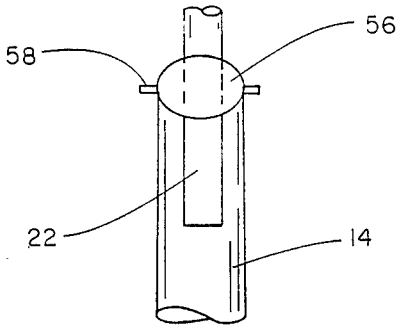
FIG. 3 is a schematic of a support joint in the configuration in which the support is partially extended in the upright configuration shown in FIG. 1.
Figure 4:
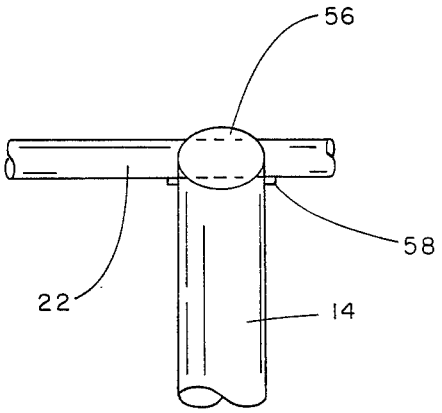
FIG. 4 is a schematic of a support joint in the configuration in which the support is angled from the upright configuration shown in FIG. 1.

The joint 20 is best shown in FIGS. 2–4, and attention is now adverted thereto. The joint 20 includes a ball 56 mounted in the sleeve 14 to be universally rotatable with respect to such sleeve. A ring 58 is mounted on the sleeve and includes means, such as a wing screw 60, or the like, to constrict the ring and squeeze the sleeve into tight contact with the ball. The constriction of the ring is sufficient to prevent rotation or movement of the ball with respect to the sleeve once the ring is fully constricted. The sleeve will thus be made of a material that permits such ring constriction to constrict the sleeve as well. A plastics-type material will permit such constriction of the sleeve. Loosening the ring will permit the ball to be rotated with respect to the sleeve for a purpose that will be apparent from the following discussion.

The ball 56 includes a bore 62 that extends diametrically through the ball and which is sized to slidingly receive the rod 22 through the ball. The ball is also made of plastics-type material so that tight constriction of the ring will also constrict the ball against the rod 22 located in the bore 62 tightly enough to hold the rod in position within the bore.

As can be seen by comparing FIGS. 2, 3 and 4, the joint 20 permits the rod to assume a variety of positions and orientations with respect to the sleeve. Thus, in FIGS. 1 and 2, the rod is collinear with the sleeve and is fully extended with respect to the sleeve; whereas, in FIG. 3, the rod is still collinear with the sleeve, but is telescoped into the sleeve from the fully extended position shown in FIGS. 1 and 2. The joint is rotated in FIG. 4 so that the bore 62 is at a right angle with respect to the axis of the sleeve whereby the rod will be held at a right angle with respect to the sleeve. In the FIG. 4 configuration, the ring will hold the ball tightly enough so that the rod will not pull the ball out of the sleeve, and since the rod is oriented horizontally, there is little likelihood that the rod will fall out of the bore 62. Thus, even in the FIG. 4 configuration, the carousel 10 will be stable. Changing the angular relationship between the rod and the sleeve is indicated in FIG. 1 by the double-headed arrow 52 and occurs in a vertical plane.

Figure 5:
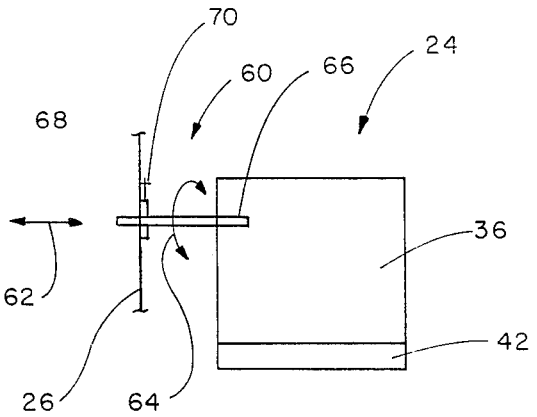
FIG. 5 is a schematic of a joint between a shoe mounting unit and a bearing element.

The position of each shoe compartment with respect to the support 26 can be altered using a joint 60 shown in FIGS. 1 and 5. The joint 60 permits the compartment to be moved toward and away from the support 26 as indicated in FIG. 5 by double-headed arrow 62 or to be rotated as is indicated in FIG. 5 by the double-headed arrow 64. Such movements will add further degrees of freedom to the carousel.

The joint 60 includes a rod 66 connecting the compartment section 46 to the support 26 and a ring 68 mounted on the support. The ring 68 is constrictable about the rod 66 and includes a means for constricting such ring, such as a wing screw 70. The rod slides through the ring, and the screw is used to establish a fixed condition of the rod with respect to the support.

When the rod 22 is angled with respect to the sleeve as indicated in FIG. 4, the compartments can be oriented to provide a stable carousel and a stable support for the shoes in such carousel. The base element 12 is wide enough to provide a stable support for the carousel, or includes a means for attaching that support element to the floor whereby the carousel is stable even in the FIG. 4 configuration.

It is understood that while certain forms of the present invention have been illustrated and described herein, it is not to be limited to the specific forms or arrangements of parts described and shown.

I claim:

1. An adjustable shoe carousel comprising:

(A) a base element;

(B) an adjustable support mounted on said base element and including (1) a sleeve element mounted at one end thereof on said base element and extending upwards therefrom, (2) a bearing joint connecting said sleeve element to said base to permit said sleeve element to rotate with respect to said base element;

(3) a rod element telescopingly mounted on said sleeve element, and (4) a coupling joint for coupling said rod element to said sleeve element and which permits said rod to move with respect to said sleeve to telescope into said sleeve and to move at an angle with respect to said sleeve; and (C) a shoe mounting unit which is mounted on said rod element and which includes (1) a support element attached to said rod element, (2) a plurality of shoe mounting compartments attached to said shoe mounting unit support element, and (3) joint means connecting each compartment to said shoe mounting unit support element to permit such compartment to move with respect to said mounting unit support element.

2. The shoe carousel defined in claim 1 wherein said coupling joint includes a sleeve ring on said sleeve element.

3. The shoe carousel defined in claim 2 wherein said coupling joint includes a ball which includes a bore defined diametrically therethrough.

4. The shoe carousel defined in claim 3 wherein each of said compartments includes a base section, a rear section, a front section and side sections.

* * * * *